US007973621B2

(12) United States Patent
Weihreter et al.

(10) Patent No.: US 7,973,621 B2
(45) Date of Patent: Jul. 5, 2011

(54) HOM DAMPED HIGH-FREQUENCY RESONATOR

(75) Inventors: Ernst Weihreter, Berlin (DE); Frank Marhauser, Newport News (DE)

(73) Assignee: Helmholtz-Zentrum Berlin Fuer Materialien und Energie GmbH, Berlin (DE)

( * ) Notice: Subject to any disclaimer, the term of this patent is extended or adjusted under 35 U.S.C. 154(b) by 50 days.

(21) Appl. No.: 10/480,320

(22) PCT Filed: Jun. 13, 2002

(86) PCT No.: PCT/DE02/02230

§ 371 (c)(1),
(2), (4) Date: Dec. 11, 2003

(87) PCT Pub. No.: WO02/104086

PCT Pub. Date: Dec. 27, 2002

(65) Prior Publication Data

US 2004/0164822 A1 Aug. 26, 2004

(30) Foreign Application Priority Data

Jun. 15, 2001 (DE) ..... 101 29 774

(51) Int. Cl.
*H01P 1/20* (2006.01)

(52) U.S. Cl. ..... 333/211; 333/17.3; 333/32

(58) Field of Classification Search ..... 333/211, 333/210, 17.3, 32

See application file for complete search history.

(56) References Cited

U.S. PATENT DOCUMENTS 4,096,457 A * 6/1978 Snyder ..... 333/208

OTHER PUBLICATIONS

Sakanaka et al: "Development of a broadband HOM load for the 714 MHz HOM damped cavity"; IEEE Particle Accelerator Conference vol. 3 May 1997 pp. 2983-2985.*

Sakanaka et al: "Design of a HOM damped cavity for the ATF damping ring"; IEEE Particle Accelerator Conference vol. 2 May 1993 pp. 1027-1029.*

Marhauser et al: "Impedance measurements of a HOM-damped low power model cavity"; IEEE Particle Accelerator Conference vol. 2 May 2003 pp. 1189-1191.*

Schonfeld et al: "Determination of Resonant frequency ad external Q values for the BESSY II HOM damped cavity"; IEEE Particle Accelerator Conference vol. 3 May 1995 pp. 1711-1713.*

Kageyama et al: "Development of a HOM damped cavity for the KEK B factory (KEKB)"; IEEE Particle Accelerator Conference vol. 3 May 1995 pp. 1759-1761.*

Pendleton et al: "Broadband coax waveguide transitions"; IEEE Particle Accelerator Conference vol. 3 May 1995 pp. 1824-1826.*

(Continued)

*Primary Examiner* — Robert Pascal
*Assistant Examiner* — Kimberly E Glenn
(74) *Attorney, Agent, or Firm* — Leyfid, Voit & Mayer, Ltd.

(57) ABSTRACT

A HOM attenuated high frequency resonator provided with a cylindrical resonator cavity on the outer surface of which are arranged three circular tapered waveguides with two symmetrically arranged ridges each, the cut-off frequency of the waveguide base mode being kept constant over the length of the waveguides by varying the height of the ridges, and the ridge waveguides being provided at their end of the smaller diameter with an impedance transformer each for the broadband adjustment of the coaxial line is to be cost-efficiently manufacturable as a compact structure and is to be of improved attenuation properties while at the same time having, relative to prior art arrangements, a high shunt impedance for the fundamental modes.

5 Claims, 3 Drawing Sheets

OTHER PUBLICATIONS

Massarotti et al: "The design of a pill-box cavity with waveguide HOM suppressors"; IEEE Particle Accelerator Conference vol. 2 May 1993 pp. 953-955.*
Conciauro et al.: "A new HOM-free accelerating resonator"; EPAC 1990, vol. 1, pp. 149 seq.
Boni, R., et al.: "HOM-free cavities"; EPAC 1996, vol. 1, pp. 148 seq.
Boni, R. et al.: "High power test of the waveguide loaded RF cavity for the Frascati O-factory main rings"; EPAC 1996, vol. 3; pp. 1976 seq.
Rimmer, R. et al.: "An RF cavity for the B-factory"; SLAC-PUB-6129, BECON-91, LBL-30624, Apr. 1993 (N).
Schoenfeld, F. et al.: "A cavity with circular waveguides for HOM damping"; EPAC 1996, vol. 3, pp. 1340 seq.
Weihreter, E. et al.: "Optimization and experimental characterization of a broadband circular waveguide to coaxial transition"; EPAC 1996, vol. 3, pp. 2065 seq.
Schoenfeld F. et al.: "A cavity with circular waveguides for HOM damping"; PD. Jun. 1997, pp. 1940-1942.
Bartalucci, S. etal.: "DAONE accelerating cavity: R&D"; P.D. Mar. 28, 1992; pp. 1263-1265.
Patent Abstracts of Japan: Publication No. 07037698.
Sobenin, N.P. et al.: "HOM damping in SBLC accelerating section using input couler"; P.D. Aug. 26, 1996; pp. 824-826.
Sakanaka, s. et al.: "Development of a broadband HOM load for the 714-MHz Hom-Damped cavitiy"; P.D. Dec. 5, 1997, pp. 2983-2985.
Tsai, Y.C. et al.: "Layout of a broadband circular waveguidemto coaxial transition"P.D. 1997, pp. 1937-1939.
Arcioni, P.: "Numerical Evaluation of Beam Coupling Impedances in heavily damped cavities";' P.D. 1993, pp. 907-909.

* cited by examiner

HOM DAMPED HIGH-FREQUENCY RESONATOR

This application is a U.S. National Phase application under 35 U.S.C. §371 of International Application No. PCT/DE02/002230, filed on Jun. 13, 2002, and claims benefit to German Patent Application No. DE 101 29 774.2, filed on Jun. 15, 2001, The International Application was published in German on Dec. 27, 2002 as WO 02/104086 under PCT Article 21(2).

BACKGROUND OF THE INVENTION

1. Field of the Invention

The invention relates to a HOM attenuated high frequency resonator provided with a cylindrical resonator cavity on the outer surface of which there are arranged three circular tapered waveguides with two symmetrically disposed connector elements, the cut-off frequency of the waveguide basic mode being kept constant over the length of the waveguides by varying the height of the connector element, the ridge waveguides at their smaller diameter end being provided with an impedance transformer for broadband HF adjustment of the coaxial line.

In electron storage rings for generating synchrotron radiation the brilliancy of the photon beams decisively depends upon the quality of the stored electron beam. Beam instabilities in particular negatively affect the generated brilliancy. The beam instabilities are cause by multibunch oscillations which cause an enlargement of the power width (longitudinal oscillations) and of the transverse emittance (transverse oscillations).

The multibunch oscillations are energized by the interaction of the electron packages with the higher order modes (HOM) of the acceleration resonator. By reducing the impedances of these HOM's below the specific critical impedance of every synchrotron source, the above-mentioned instabilities may be suppressed.

2. The Prior Art

For the suppression of the instabilities, various solutions in respect of resonators are known in the prior art.

For instance, Proc. Of the European Particle Accelerator Conference (EPAC 1990), Vol. 1, pp. 149; Proc. Of the European Particle accelerator Conference (EPAC 1996), Vol. 1, pp. 148 as well as Vol. 3, pp. 1976, describe the resonator at the Laboratori Nazionale di Frascati, INFN, at Frascati, Italy. This resonator consists of a bell-shaped resonator cavity provided with three long rectangular waveguides for HOM attenuation which are arranged at an angle of about 15 degrees relative to the axis of the resonator. As a consequence of this geometry and of the long steel pipes of truncated conical configuration for adjusting the large diameter at the pipe to the vacuum chamber of the ring, the installation length in the axial direction is about 2 m. The broadband rectangular waveguides are provided with an adaptor to a ⅞" EIA coaxial line for coupling out the HOM energy. Not least because of the large diameters of the openings of the steel pipes is it possible to attain HOM impedances of relatively low value. This advantage is, however, achieved at the expense of a significantly reduced shunt energy of the basic made which results in higher, operating costs.

Another solution of coupling radially arranged waveguides to the interfering HOM's has been developed for the cavity (cavity resonator) by the Stanford Linear Accelerator Center, SLAC, at Stanford, U.S.A. (described, for instance, in SLAC-PUB-6129, LBL-30624, BECON-91, April 1991). This arrangement consists of a resonator cavity of spherical radial contour and three rectangular waveguides for the attenuation of HOM. The waveguides are arranged on the resonator at an angle of about 30 degrees relative to the beam axis, are then oriented parallel to the axis, and are finally, to save space, bent by 180 degrees. The HOM energy is absorbed in ferrite absorbers in the interior of the waveguides. As a consequence of the geometry of the arrangement the installation length in axial direction is about 1.8 m.

Both mentioned resonators have been developed for use in electron-positron-storage rings for high energy physics with extended straight sections and are thus of limited utility in connection with synchrotron radiation sources.

A resonator of the kind proposed by the Berliner Elektronenspeicherring-Gesellschaft fuer Synchrotronstrahlung m.b.H. is described in Proc. Of the European Particle accelerator Conference (EPAC 1996), Vol. 3, pp. 1940. In this case, the high frequency resonator is provided with a cylindrical resonator cavity on the outer surface of which there are arranged three circular waveguides for coupling to the HOM's each one of which is connected to a broad-band transition to a coaxial line (broad band circular waveguide to coaxial transition—CWCT). This arrangement allows reducing the necessary dimensions, in particular the installation length, relative to prior art devices. In Proc. Of the European Particle Accelerator Conference (EPAC 1998), Vol; 3, pp. 2065 a circular waveguide for such an arrangement has been described which is structured as a tapered ridge waveguide with a constant cut-off frequency and an impedance transformer to the ⅞" coaxial line. As has already been mentioned, it was possible to reduce the dimensions of a HOM-attenuated high frequency resonator; however, the reduction of the shunt impedance of the fundamental mode is relatively large and the attenuation efficiency for higher order modes is insufficient.

OBJECT OF THE INVENTION

It is, therefore, an object of the invention to provide for a compact HOM-attenuated HF-resonator of improved attenuation properties which can be manufactured cost-efficiently and which, at the same time, is of high shunt impedance as regards the fundamental mode

SUMMARY OF THE INVENTION

In accordance with the invention, the object is accomplished in a HOM-attenuated high frequency resonator of the kind referred to above by the waveguides being arranged in an offset manner on the outer surface of the resonator cavity with two symmetrically arranged ridges for an asymmetric setting relative to the center plane thereof, that the angularity of the waveguides with two symmetrically arranged ridges may be adjusted relative to the axis of the cylindrical resonator cavity and that the ridges of the waveguides protrude into the cylindrical resonator cavity such that the higher order modes are coupled in an optimum manner.

For an efficient reduction of the HOM impedances it is significant that at as large a coupling as possible the adjustment of the circular waveguides is of the broadest possible bandwidth and of the lowest possible reflection. These effects are being realized by the solution in accordance with the invention.

In order to ascertain that the modes which are symmetric relative to the center plane as well as the asymmetric modes are efficiently coupled out, the circular waveguides are offset relative to the center plane of the cylindrical resonator cavity in the direction of the longitudinal axis thereof.

Since the structure of the waveguides is such that their angularity relative to the axis of the cylindrical resonator cavity may be adjusted, for instance by being connected to the resonator cavity by rotationally symmetric UHV (ultra high vacuum) flanges, the orientation of the waveguide ridge relative to the beam axis is selectable. This makes it possible selectively to optimize the coupling to individual HOM's which are particularly disturbing in a specific storage ring.

Since the waveguides and their ridges protrude into the cavity of the resonator more deeply than provided for by the coupling element, for instance the flanges referred to, the solution in accordance with the invention ensures that the vacuum transitions and the HF transitions are not realized at the same site. The length of that part of the waveguide ridges protruding into the resonator cavity (in addition to other geometric parameters) is varied by numeric simulation such that the HOM impedances above the cut-off frequency (650 MHz) is minimized up to 3 GHz.

The setting of the angularity of the waveguide ridge relative to the axis of the cylindrical resonator chamber in particular by means of rotationally symmetric flanges makes possible an optimum coupling of particularly disturbing HOM's.

In one embodiment, the ridges of the waveguides are aligned parallel relative to the axis of the cylindrical resonator cavity, i.e. the angle of the ridge waveguides with respect to the axis of the cylindrical resonator chamber is zero degrees. This embodiment constitutes the optimum solution in cases in which all HOM's are excited by the electron beam with the same power. Where this is not the case, the adjustability of the orientation of the waveguide ridges allows for a minimization of the HOM's specific to the storage ring.

In another embodiment, the circular tapered ridge waveguides have ridges of variable height defined over the length of the tapered waveguide by the second order polynomial $$y=3.6328+0.0347513x+0.000183869x^2,$$

where x is the length (in mm) of the tapered waveguide and y is half the spacing of the ridges (in mm) between each other. This profile of the ridges is particularly advantageous since the cut-off frequency of the waveguide is maintained constant and that the factor of reflection of the tapered waveguide section in the above-mentioned range of frequencies is thus minimized.

A further embodiment provides for the impedance transformer having a section structured as a tapered coaxial coupling. This makes possible to utilize any kind of vacuum HF window configurations.

For optimizing the shunt impedance of the fundamental mode, the resonator cavity, in a further embodiment, is provided with a beam hole of nose-like expansions. This utilized nose-cone geometry in the area of the beam hole results in a concentration of the accelerated field on the axis of the resonator which leads to a large shunt impedance and, at the same time, a high HOM attenuation. The realization of a high shunt impedance ensures a more energy-efficient acceleration of the electron beam during operation of the accelerator, relative to prior art arrangements.

By its compact structure, the solution in accordance with the invention makes possible the utilization of HOM attenuated resonators in most synchrotron radiation sources. With round waveguides, the maximum local thermal energy densities on the interior surface of the resonator in the transition area between waveguide and resonator wall (at an external energization of the base mode) are about 50% lower than with rectangular waveguides. This makes possible a significantly simpler structuring of the cooling water ducts. Seen from the point of view of construction, the connection of a round waveguide with a cylindrical resonator is simpler and more cost efficient than is the connection between a rectangular waveguide with a spherical or ball-shaped arrangement. Compared to solutions mentioned in the prior art, the manufacturing costs amount to about 40% only. The nose-cone geometry used for structuring the beam hole results—as has been mentioned already—in a high shunt impedance of the fundamental mode at a simultaneous more efficient HOM attenuation.

DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

DESCRIPTION OF THE PREFERRED EMBODIMENT

Figure 1:
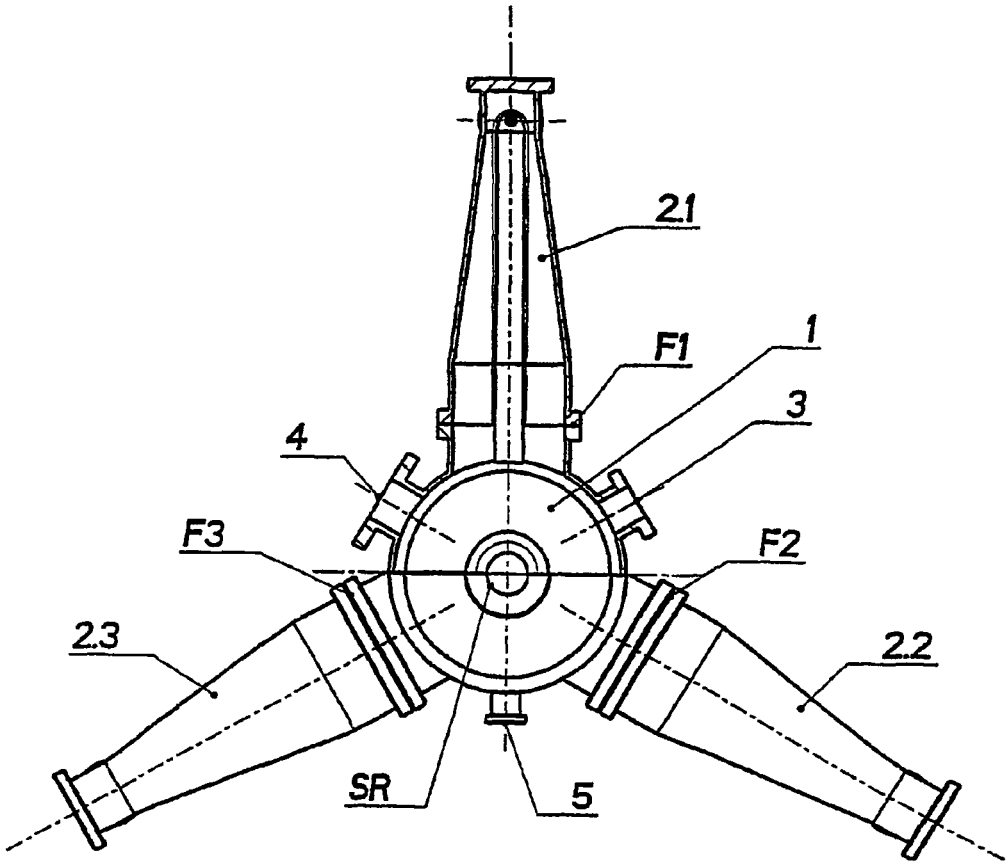
FIG. 1 is a schematic overall presentation of a HOM attenuated HF resonator in the direction of radiation.

A HOM attenuated HF resonator is schematically depicted in FIG. 1. In a normally conducting 500 MHz acceleration resonator for synchrotron sources, three circular ridge waveguides 2.1; 2.2; 2.3 are mounted by flanges F1; F2; F3 on a cylindrical resonator cavity 1. The flanges F1; F2; F3 allow setting the orientation of the rides of the waveguides 2.1; 2.2, 2.3. The figure also shows the opening for an input coupling element 4, the opening for the tuner 3, and the opening for the connector to a measuring loop 5.

Figure 2:
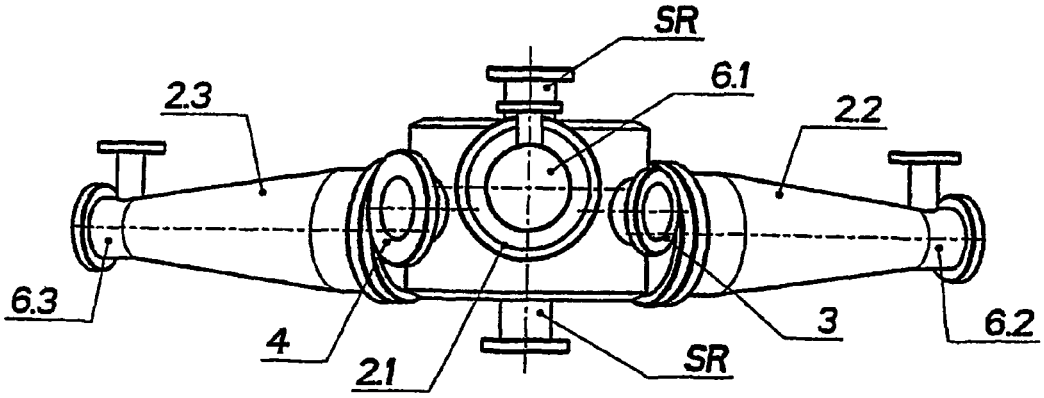
FIG. 2 is a schematic side view in accordance with FIG. 1.

In the side view according to FIG. 1 schematically shown in FIG. 2, the offset relative to each other of the three waveguides 2.1; 2.2; 2.3 disposed on the outer surface of the resonator cavity 1 in the direction of its longitudinal axis may be well recognized. This figure also depicts the impedance transformers 6.1; 6.2; 6.3. The shown offset in accordance with the invention of the waveguides 2.1; 2.2; 2.3 with respect to each other results in an efficient output coupling of the mode dispose symmetrically of the center plane as well as the asymmetric ones. Also shown is the beam pipe SR into which the resonator cavity 1 has been fit.

Figure 3:
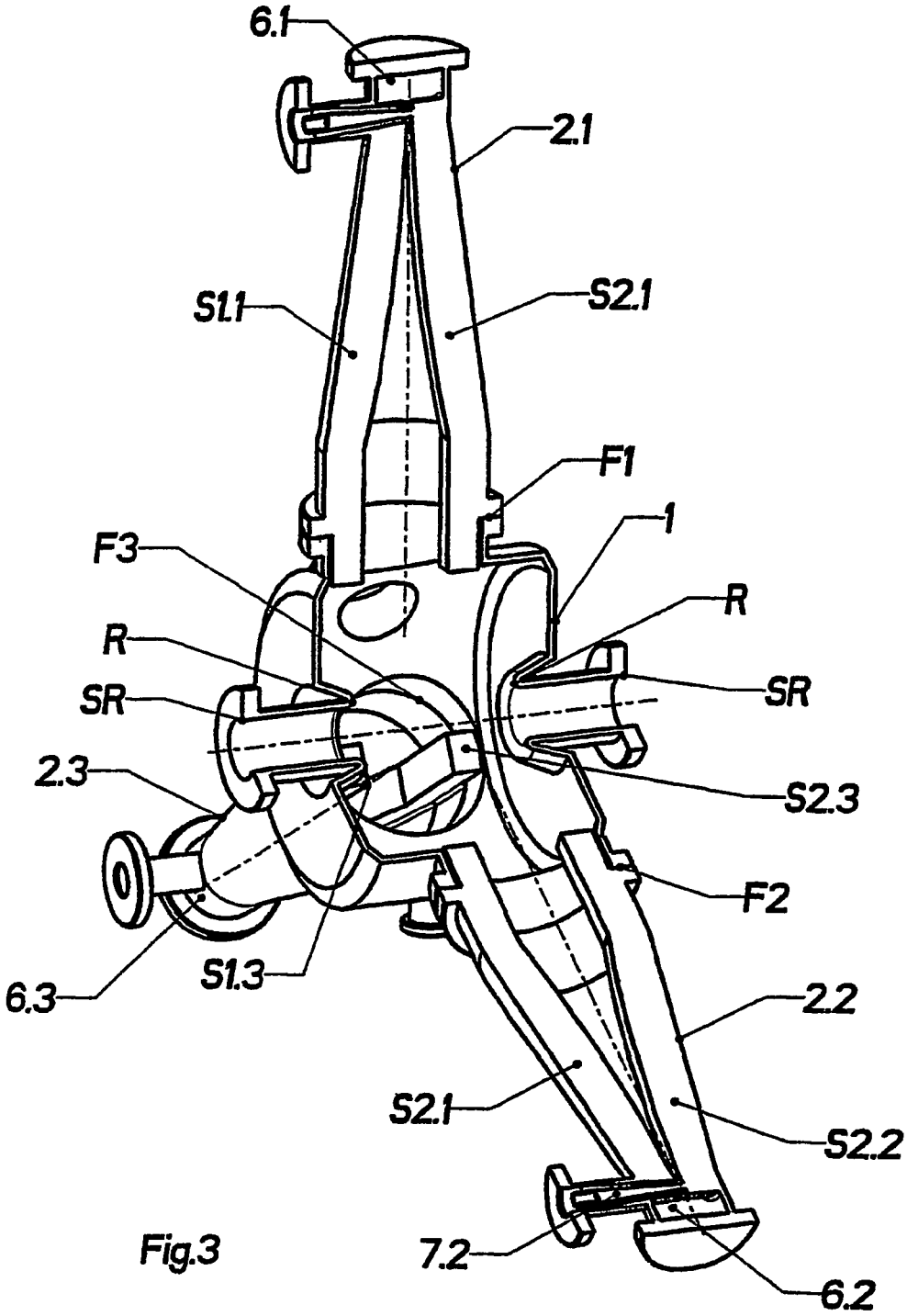
FIG. 3 is a schematic spatial presentation in section through a HOM attenuated HF resonator in accordance with FIG. 1.

FIG. 3 is a schematic spatial representation in section of the HOM attenuated HF resonator shown in FIG. 1. It may be clearly seen here how each of the two ridges S1.1 and S2.1; S1.2 and S2.2; S1.3 and S2.3 of the three waveguides 2.1; 2.2; 2.3 protrude into the resonator cavity 1, i.e. the length of the ridges S1.1; S2.1; S1.2; S2/2; S1.3; S2.3 is greater than the length of the walls of the waveguides 2.1; 2.2; 2.3. In this manner an improved coupling of higher modes is attained relative to prior art devices. The circular waveguide 2.1; 2.2; 2.3 are connected to the resonator cavity 1 for adjusting their orientation relative to the beam axis which makes possible a storage ring specific optimization of the coupling of particularly disturbing HOM's. The hole R of the beam pipe SR in the resonator chamber 1 is of nose cone geometry by which—as has already been described—a concentration of the accelerating field on the resonator axis is realized.

Each waveguide 2.1; 2.2; 2.3 has—as shown in FIG. 3—associated therewith one impedance transformer 6.1; 6.2; 6.3 each. These impedance transformers 6.1; 6.2; 6.3 are provided with a section 7.1; 7.2; 7.3 structured as a tapered coaxial line. The special structure of the waveguides 2.1; 2.2; 2.3 with their two symmetrically arranged ridges S1.1 and S2.1; S1.2 and S2.2; S1.3 and S2.3 penetrating into the resonator cavity 1 may be recognized particularly well in this sectional representation.

Figure 4:
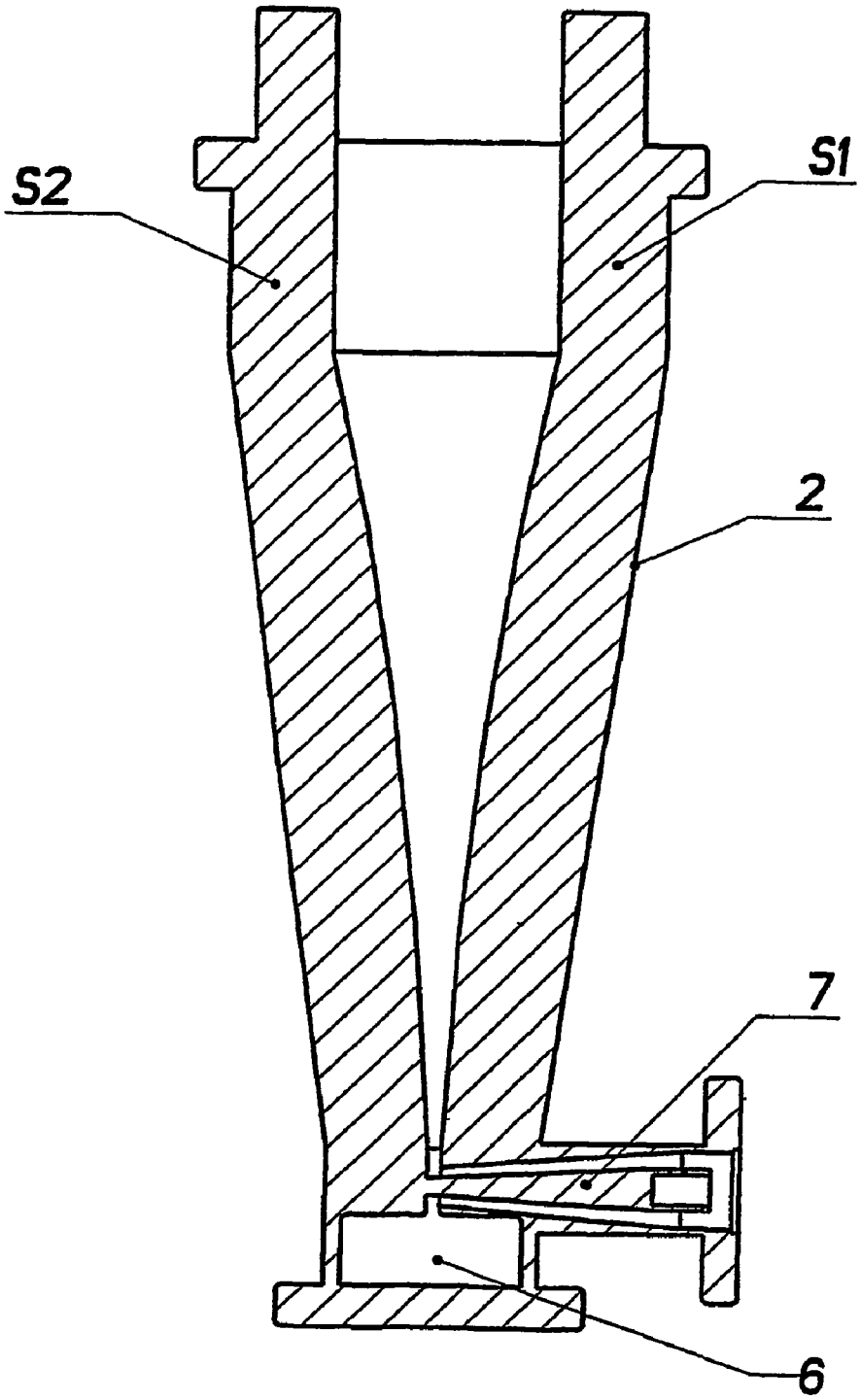
FIG. 4 is a ridge waveguide schematically shown in longitudinal section.

FIG. 4 depicts one of the three circular waveguides 2 with two symmetrically arranged ridges S1; S2 in longitudinal section. The spacing between the two ridges S1; S2 between each other in the waveguide 2 is defined, for instance, by the second order polynomial $y=3.6328+0.0347513x+0.000183869x^2$, where x is the length (in mm) of the tapered waveguide 2 and y is half the spacing of the ridges (in mm) S1; S2 between each other. By the ridge profile, the cut-off frequency of the waveguide 2.1; 2.2; 2.2 is kept constant and—as has already been mention—the factor of reflection of the tapered waveguide section in the frequency range 650 MHz to 3 GHz is minimized thereby.

It was possible numerically to prove that the solution in accordance with the invention makes possible the realization of an accelerator resonator which ensure the almost complete suppression of multi-bunch instabilities in modern synchrotron radiation sources of the third generation. Moreover, it was possible to show that the maximum current thresholds in synchrotron radiation sources could be raised for resonators by a factor of 2, compared to prior art devices.

What is claimed is:

1. A HOM attenuated high frequency resonator, comprising:

a cylindrical resonator cavity on the outer surface of which are arranged three circular tapered waveguides with two symmetrically arranged ridges each, a cut-off frequency of a waveguide base mode being kept constant over the length of the waveguides by varying the height of the ridges, and the waveguides being provided at an end of the waveguides having a smaller diameter with an impedance transformer each for a broadband adjustment of a coaxial line, wherein the waveguides with two symmetrically arranged ridges for adjusting an asymmetry relative to a center plane of the cylindrical resonator cavity are arranged offset on the outer surface of the resonator cavity, and the waveguides with the two symmetrically arranged ridges are structured for adjusting an angularity of the waveguides relative to an axis of the cylindrical resonator cavity and the ridges of the waveguides protrude into the cylindrical resonator cavity such that modes of higher order are optimally coupled.

2. The HOM attenuated resonator of claim 1, wherein the ridges of the waveguides are arranged parallel relative to the axis of the cylindrical resonator cavity.

3. The HOM attenuated resonator of claim 1, wherein the waveguides have a ridge height defined over the length of the waveguide by a second order polynomial $$y=3.6328+0.0347513x+0.000183869x^2,$$

wherein x is the length (in mm) of the tapered waveguide and y is half the spacing of the ridges (in mm) between each other.

4. The HOM attenuated resonator of claim 1, wherein each impedance transformer is provided with a section structured as the coaxial line.

5. The HOM attenuated resonator of claim 1, wherein the resonator cavity is provided with a beam hole of nose-shaped expansion for a concentration of an accelerating field on the axis of the cylindrical resonator cavity.

* * * * *